US006315911B1

(12) United States Patent
Radsky

(10) Patent No.: US 6,315,911 B1
(45) Date of Patent: Nov. 13, 2001

(54) SELF-TENDING, MULTI-POSITION DEBRIS DEFLECTOR FOR POOLS

(76) Inventor: David F. Radsky, R.R. 9, Box 439, Augusta, ME (US) 04330

( * ) Notice: Subject to any disclaimer, the term of this patent is extended or adjusted under 35 U.S.C. 154(b) by 0 days.

(21) Appl. No.: 09/635,009

(22) Filed: Aug. 9, 2000

Related U.S. Application Data

(63) Continuation-in-part of application No. 29/109,145, filed on Aug. 10, 1999, now Pat. No. Des. 437,465.

(51) Int. Cl.[7] ..... C02F 1/00; E04H 4/16

(52) U.S. Cl. ..... 210/776; 210/169; 210/232; 210/242.1

(58) Field of Search ..... 210/776, 169, 210/232, 242.1; 4/496

(56) References Cited

U.S. PATENT DOCUMENTS

| | | | |
|---|---|---|---|
| D. 282,302 | | 1/1986 | Reynoso et al. . |
| D. 314,456 | | 2/1991 | Baitz . |
| D. 437,465 | * | 2/2001 | Radsky . |
| 3,774,767 | * | 11/1973 | Field . |
| 4,068,327 | * | 1/1978 | Heinlein . |
| 4,221,662 | | 9/1980 | Joseph . |
| 4,225,436 | | 9/1980 | Cseh . |
| 4,369,109 | | 1/1983 | Edge . |
| 4,707,253 | | 11/1987 | Rowe . |
| 4,720,340 | | 1/1988 | O'Brien . |
| 4,734,189 | | 3/1988 | Page, Jr. . |
| 4,781,827 | * | 11/1988 | Shields . |
| 4,789,470 | | 12/1988 | Wards . |
| 4,820,411 | | 4/1989 | Lempio . |
| 4,960,514 | | 10/1990 | Paskert . |
| 5,173,181 | * | 12/1992 | McFarland . |
| 5,275,721 | | 1/1994 | Mathews . |
| 5,336,400 | | 8/1994 | Patrice . |
| 5,391,296 | | 2/1995 | Rotundo . |
| 5,392,472 | | 2/1995 | Maxfield . |
| 5,422,001 | | 6/1995 | Yagoda et al. . |
| 5,510,020 | | 4/1996 | Gronlund . |
| 5,525,217 | | 6/1996 | Fulop . |
| 5,606,750 | | 3/1997 | Vos . |
| 5,614,085 | | 3/1997 | Platt, III . |
| 5,804,064 | | 9/1998 | Desrochers . |
| 5,849,184 | | 12/1998 | Veillet . |

* cited by examiner

*Primary Examiner*—Chester T. Barry
*Assistant Examiner*—Fred Prince
(74) *Attorney, Agent, or Firm*—Stan Jones, Patents

(57) ABSTRACT

A swimming pool debris deflector apparatus having a floating deflector arm and two adjustable orthogonal members which provide a mating to existing swimming pool skimmer entrance ports. A pair of anchor points including a finger hole in a skimmer basket cover and a resting point against the side of the pool stabilize the deflector adjacent the skimmer entrance port. The deflector includes adjustments for positioning the debris deflection for clockwise or counter clockwise pool flow caused by the pool filtration system.

18 Claims, 1 Drawing Sheet

Fig. 1
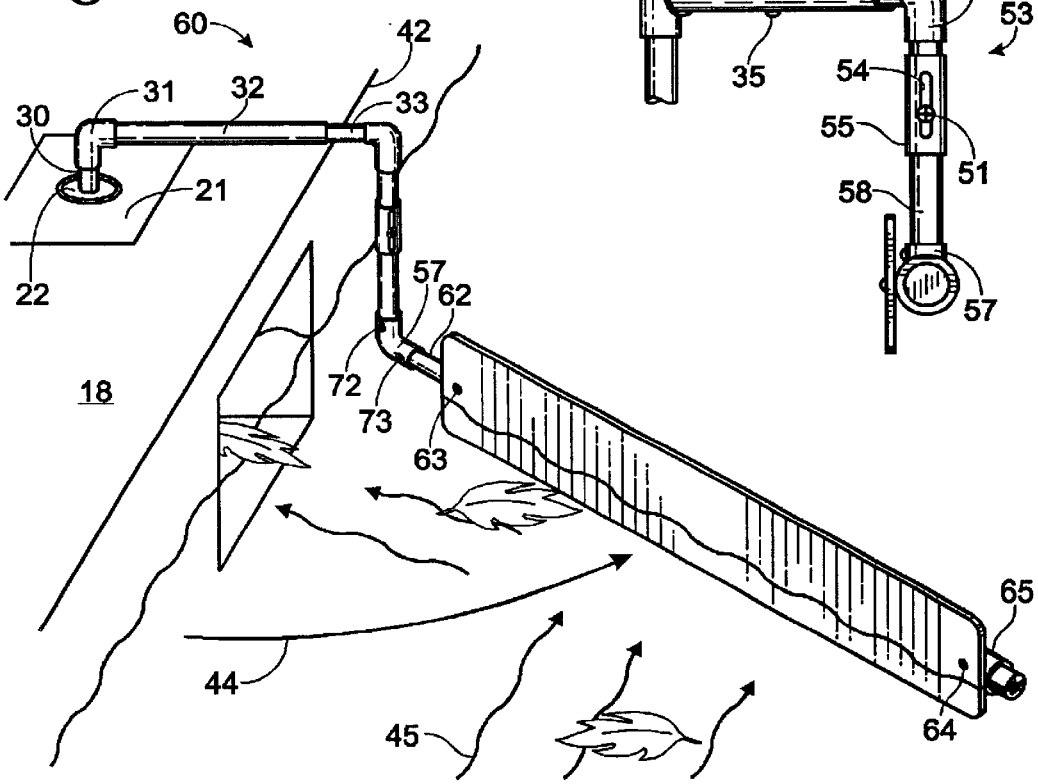
Fig. 3
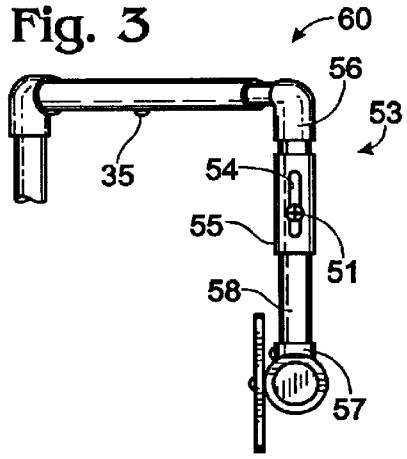
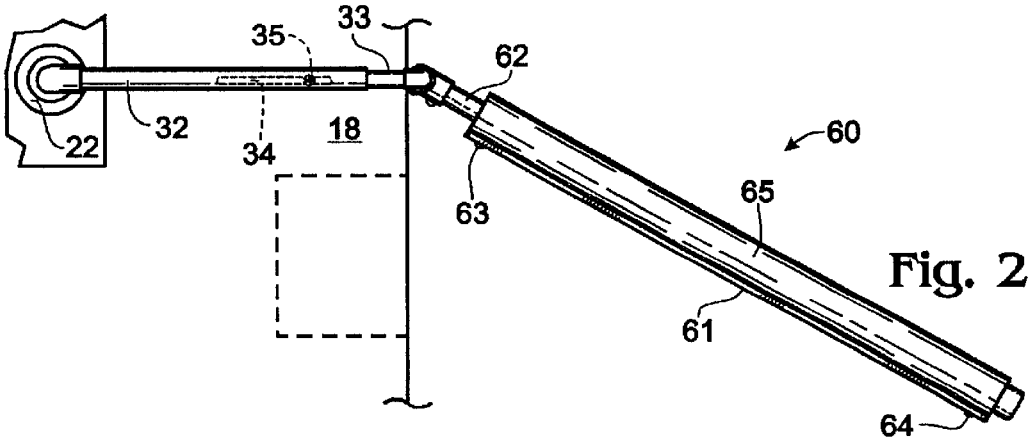
Fig. 2

SELF-TENDING, MULTI-POSITION DEBRIS DEFLECTOR FOR POOLS

RELATED APPLICATIONS

This application is a continuation-in-part of my application entitled MULTI-POSITION POOL SKIMMER, filed on Aug. 10, 1999 and having Ser. No. 29/109,145 which application issued as U.S. Patent Des.437,465 on Feb. 6, 2001.

FIELD OF THE INVENTION

The field of the present invention relates to a swimming pool deflector for directing floating debris into standard pool skimming devices. Further, the field of this pool deflector invention relates to one that is self-tending and requires no tools nor permanent attachment apparatus for its removal or installation. My method invention includes the novel steps of stabilizing a floating deflector at two points which include the side of the pool and the finger hole of an access cover for a swimming pool skimmer entrance port.

EXPLANATION OF TERMS

My invention interfaces and operates in conjunction with other swimming pool fixtures and apparatus. Provided below are brief descriptions of certain relevant devices which further the understanding of the invention and provide a basis for a detailed teaching of the improvement in the art provided by this invention.

Filtration System

All swimming pools have a filtration system for continual cleaning of pool water. These filter systems employ circulating pumps which maintain a flow of water from the pool through the filters and return the filtered water back to the pool. The first stage of the filter system is a coarse skimmer trap which catches leaves and other floating debris as such debris works its way into the trap. This skimmer trap is standard in most pools, with only minor variations in distance from the edge of the pool.

Pool Deck

A horizontal concrete, paver or tiled surface which surrounds the edge of the swimming pool. The skimmer trap is located below the deck and that trap is the first coarse stage in the filtration loop for the pool.

Filter Access Plate

The aforementioned skimmer trap includes a removable catch basin that is easily removable/replaceable for periodic cleaning of skimmed debris caught in the basin. An access port is located in an opening in the pool deck above the catch basin. That access port normally takes the form of a removable cover plate. Such a plate is generally flush mounted in the pool deck directly above the water entrance port to the filtration system skimmer. Access cover plates are equipped with a finger hole opening for ease in manual removal and replacement.

Pool Deflector

Generically, a device that floats on, and extends slightly below the pool water surface in order to deflect floating surface debris into the skimmer and associated filtering circulation apparatus.

Surface Flotation Rod

A length of flotation material on the pool deflector proper that surrounds a hollow, sealed rod that is situated at water level. The flotation rod is perhaps two to three feet in length. Attached to the floatation rod is a flat plate deflector with its flat surface perpendicular to the water surface. Attachment may be via sheet metal type screws. The deflector plate is positionally reversible in order to accommodate clockwise or counter clockwise water flow in the pool.

Knuckle

This is a direction-changing elbow connected to the floatation rod which acts as a deflector stop against the side of the pool. Seated in the knuckle is an upright extension rod that is telescoped and adjustable to accommodate different depths of the water surface relative to the pool deck.

Adjustable Deck Arm

This adjustment is located in a telescoping extension arm which runs from the pivot point in the cover plate outward over the edge of the deck. It provides an inward and outward sliding distance and is normally adjusted once for any given pool. Such a one time setting is necessary because the skimmer access ports from pool to pool are not always the same distance from the edge of the pool. Geometrically, this adjustable arm sets the chord length of a given radius arc which defines the angle of deflection for the deflector. Additionally, this adjustment presets the point at which the deflector rests against the edge of the pool.

BACKGROUND OF THE INVENTION

The environmental requirements for this invention are well known. Outside swimming pools have the problem of debris from the atmosphere—leaves, twigs, and the like—littering the pool. Indoor pools, to a lesser degree, likewise accumulate floating debris. Swimming pools are thus equipped with water circulation and filtering apparatus, which circulate and filter pool water.

As a side effect of this circulating filter system, there is generated within the pool, a slow, steady clockwise, or counter-clockwise rotation of the pool water. The flow in such a pool becomes very laminar, and floating debris becomes entrained in the laminar flow and tends to bypass the skimmer entrance to the filtering system.

Thus, a need quickly developed for a deflector which resides near the skimmer circulation entrance, which deflector stays in place during the many hours when a pool is not in use. Also such a deflector must easily be removable when the pool is put into use and for safety sake must not require any obtrusive attachment mechanisms. This invention supplies for the first time just such a swimming pool deflector apparatus.

The laminar flow phenomenon had lead to dozens of prior art methods and attempts in the art for a safe, workable deflection apparatus that serves to interrupt a portion of that flow, and redirect floating debris into the skimmer entrance for the filtration system. Although these devices are truly surface water deflectors, some in the art have misused the word "skimmer". A skimmer is actually an operator or machine moved cleaning apparatus. When manually moved, such a skimmer takes the from of a hand held combination pole and net that is manually moved about the pool surface to clean a large surface area.

There have been many prior art attempts to create deflectors which will do the job in a satisfactory manner. Those attempts to date have various shortcomings such as undue complexity and compromises for deck or pool safety. Most of these prior art devices are removeably connected to the pool by a permanent attaching fixture element that is somehow permanently affixed to the deck, pool side, skimmer opening, pool ladder or the like. These attachment elements in and about the pool periphery are obtrusive and create safety hazards.

Additionally, many of the attachment elements require the installer to work from within the pool. An aftermarket exists for a pool flow deflector which may easily be hand installed and hand removable, and which does not modify the surroundings and/or pool equipment in any way. Of particular importance is a pool deflector that does not rely upon attachment elements and the attendant safety hazards such elements create.

DESCRIPTION OF PRIOR ART

Turning now to the prior art, a search has revealed various patents, several of which are only of peripheral relevance. Additionally the Patent Office has cited certain art in connection with the examination and allowance of the earlier parent application. Such patents include:

U.S. Pat. No. 4,820,411 to Lempio (Apr. 11, 1989)
U.S. Pat. No. 5,275,721 to Mathews (Jan. 4, 1994)
U.S. Pat. No. 5,329,472 to Maxfield (Feb. 28, 1995)
U.S. Pat. No. 5,606,750 to Vos (Mar. 4, 1997)
U.S. Pat. No. 5,614,085 to Platt III (Mar. 25, 1997)
U.S. Pat. No. 4,707,253 to Rowe (Nov. 17, 1987)
U.S. Pat. No. 5,422,001 to Yagoda et al. (Jun. 6, 1999)
U.S. Pat. No. 5,849,184 to Veillet (Dec. 15, 1998)
U.S. Pat. No. 4,369,109 to Edge (Jan. 18, 1983)
U.S. Patent Des. 282,302 to Reynoso et al. (Jan. 21, 1986)
U.S. Pat. No. 4,225,436 to Cseh (Sep. 30, 1980)
U.S. Pat. No. 5,336,400 to Patrice (Aug. 9, 1994)
U.S. Pat. No. 4,960,514 to Paskert (Oct. 2, 1990)
U.S. Pat. No. 4,789,470 to Wards (Dec. 6, 1988)
U.S. Pat. No. 4,720,340 to O'Brien (Jan. 19, 1988)
U.S. Pat. No. 5,804,064 to Desrochers (Sep. 8, 1998)
U.S. Pat. No. 5,525,217 to Fulop (Jun. 11, 1996)
U.S. Pat. No. 5,391,296 to Rotundo (Feb. 21, 1995)
U.S. Pat. No. 4,734,189 to Page, Jr. (Mar. 29, 1988)
U.S. Pat. No. 4,068,327 to Heinlein (Jan. 17, 1978)
U.S. Pat. No. 5,510,020 to Gronlund (Apr. 23, 1996)
U.S. Pat. No. 4,221,662 to Joseph (Sep. 9, 1980)
U.S. Patent Des. 314,456 to Baitz (Feb. 5, 1991)

Highly summarized the above-mentioned prior art falls into three general categories. Such art has been categorized as hand held and moveable pool skimmer or catchers; deflectors with permanent fixtures attached to the edge and/or face of the pool; and, those with attachments and/or apparatus mounted inside the suction or skimmer entrance port.

| | | |
|---|---|---|
| 4,820,411 | April 11, 1989 | Lempio |
| 5,275,721 | Jan. 4, 1994 | Mathews |
| 5,329,472 | Feb. 28, 1995 | Maxfield |
| 5,606,750 | Mar. 4, 1997 | Vos |
| 5,614,085 | Mar. 25, 1997 | Platt III |
| 4,707,253 | Nov. 17, 1987 | Rowe |

-continued

| | | |
|---|---|---|
| 5,422,001 | June 6, 1999 | Yagoda et al |
| 5,849,184 | Dec. 15, 1998 | Veillet |
| 4,369,109 | Jan. 18, 1983 | Edge |
| Des. 282,302 | Jan. 21, 1986 | Reynoso et al |

The above listed patents have only a very limited relevance. These devices have been developed for operation by a user who walks the periphery of the pool. The disclosed objective is to skim, catch or scoop leaves in a one time, real time manner—in effect a morning pool cleaning operation by a user. My invention functions passively and continually when the pool is not in use.

| | | |
|---|---|---|
| 4,225,436 | Sept. 30, 1980 | Cseh |
| 5,336,400 | Aug. 9, 1994 | Patrice |
| 4,960,514 | Oct. 2, 1990 | Paskert |
| 4,789,470 | Dec. 6, 1988 | Wards |
| 4,720,340 | Jan. 19, 1988 | O'Brien |
| 5,804,064 | Sept. 8, 1998 | Desrochers |

The above listed patents have individual limitations which are obviated by my invention. However, across the board, each of those patents listed require apparatus permanently attached to the pool deck and/or face. Furthermore, these devices are difficult—if not impossible—to remove or install from outside the pool. By contrast, my inventive device may be hand installed by a child by the simple procedure of dropping a single vertical pivot rod into the existing finger hole of the filter access plate. Additionally, should one forget to remove my deflector before entering the pool, it can be just as easily be lifted out from within the pool.

| | | |
|---|---|---|
| 5,525,217 | June 11, 1996 | Fulop |
| 5,391,296 | Feb. 21, 1995 | Rotundo |
| 4,734,189 | Mar. 29, 1988 | Page, Jr. |
| 4,068,327 | Jan. 17, 1978 | Heinlein |
| 5,510,020 | Apr. 23, 1996 | Gronlund |
| 4,221,662 | Sept. 9, 1980 | Joseph |
| Des. 314,456 | Feb. 5, 1991 | Baitz |

The above listed patents generally have complex, and some permanent attachments to, and within the interior of the water return port. Several of them are spring loaded and are trouble by failure due to water and the debris which they are supposed to deflect. As such, these prior art mechanisms are subject to failure.

My invention in contrast has no mechanical devices which are exposed to such debris exposure. Moreover, my device performs its desired function and may be both removed and installed as a one piece apparatus, which none of the above-mentioned prior art attempt to accomplish. In point of fact, their designs dictate that certain portions of their apparatus must be permanently affixed and left in the pool.

The advantages and inventive nature of my device over the aforementioned body of prior art is significantly two fold. First, I can effectively position my deflector within the pool using no additional apparatus attached to the pool. Secondly, I can remove—with one hand and no tools—the entire deflector device from the pool. A single vertical motion while outside and on the deck of the pool simply achieves removal or replacement.

Additionally, should a swimmer forget to remove my deflector prior to pool use, it can easily be lifted from its position by a swimmer from within the pool. Once removed, the pool deck is completely without obstruction and the safety hazards of the prior art are not present with my invention.

SUMMARY OF THE INVENTION

My pool flow deflector invention may be hand installed and requires no modification to the pool or surrounding area. Further, my invention installs by dropping a single mating vertical, cylindrical pivot rod into the existing oversized, concentric finger hole in the filter access plate; and, when removed, my invention leaves no part thereof attached in any way to the pool or pool equipment thus maintaining a flush and safe deck surface.

Further yet, my deflector is equipped with simple slide and set screw adjustments which angularly position the deflector relative to the pool water circulation adjacent to the filter skimmer entrance. The vertical side of the pool itself serves as a simple stop for angularly holding my deflector in place adjacent to the skimmer entrance port. Additionally, my novel device uses a similar set screw adjustment in conjunction with concentrically sliding members for a one time field setting as required by a particular pool configuration.

OBJECTS OF THE INVENTION

It is an object to provide a self maintaining floating pool deflecting face within a circulating pool flow stream for deflecting fallen and floating debris.

It is an object to provide a means of equal deflection for either of two directions of water flow movement caused by the pool filtration system.

It is an object to provide a hand attachment of a removable deflector free of attachment fixture or additional tools.

It is an object to provide an adjustable setting for my floating deflector face relative to the surface flow direction of the pool.

It is an object to provide an integral stop against the existing pool side, which stop effectively positions the angular setting of the deflector relative to the skimmer entrance.

It is an object to provide simple adjustments for variations in distance between a pool edge and the finger hole of filter access plate and the distance of the deck to water surface.

It is an object to provide a simple efficient deflector device for which replacement parts are readily available at any local hardware store.

It is an object of the invention to a provide an efficient pool deflector with a minimum number of moving mechanical springs, hinges or similar parts.

It is an object to provide positive floatation for the deflector rod that promotes a self tending deflector operation.

It is an object to provide a method and apparatus which is easily and simply removal by hand from outside of the pool.

It is an object to provide a method, if desired, for hand removal from within the pool.

It is an object to provide a deflector apparatus that is removable as one unit and leaves no permanently attached obtrusive fixture obstructions when my deflector is removed.

BRIEF DESCRIPTION OF THE DRAWING

FIG. 1 is a perspective view of the invention showing its positioning relative to the pool and adjacent to a skimmer entrance port.

FIG. 2 is a plan view from the above side of the deflector apparatus of FIG. 1.

FIG. 3 is a side view of the deflector apparatus of my invention.

DESCRIPTION OF EMBODIMENT(S)

In a preferred embodiment, shown in FIG. 1, my deflector apparatus 60 may be constructed of standard plastic pipe that is readily available at most home supply stores. Such plastic pipe may easily be sealed by caps and elbows so as to aid in the flotation of my deflector arm 61. Additionally, the larger outer cylindrical sleeve 65 may be chosen from a waterproof pipe insulation foam that is provided with trapped air pockets. Obviously other materials may be used but the described ones are readily available if some repair parts become necessary.

My deflector apparatus is constructed as an orthogonal pipe section that parallels the pool deck, vertically drops to the water surface and extends again horizontally resembling the shape of a stair step. Partially submerged in the pool water surface is a floating deflector which is connected at one end to the outrigger structure. The outrigger portion above the deck side includes an elbow 31 and a downward stub 30 which is pivotally dropped in place at skimmer cover plate 21. Pivot stub 30 seats in finger hole 22 (shown exaggerated) and thus pipe sections 32, 33 extend above the deck surface 18.

The pivot point of securement 22 is a singular loose fit of a vertically oriented cylindrical pivot member 30 within an already existing finger hole that is provided in the skimmer access cover 21. My entire deflector 60 is light weight and floats on the water surface. Deflector 60 pivots and self adjusts with surface movement of the pool water. No attachment fixtures are required and thus my deflector apparatus 60 is both self-tending and easily put into or removed from operation, as required.

Further describing the components of my deflector 60 pivot 30 is connected at one side of a right-angle elbow 31, which elbow is connected at the other side to my horizontal adjustment rod 32. Adjustment rod 32 runs horizontally above the deck surface at a height determined by the flotation members 62, 65 and the surface of the pool water relative to deck 18.

Telescoped within section 32 is another horizontal section which together—and in conjunction with slot 34 and set screw 35—serve as a first adjustment assembly. The adjustment for the horizontal arm is best shown in more detail in FIG. 2. As there shown, a length adjustment is simply provided by slot 34 running longitudinally along a portion of the length of rod 32. By loosening and tightening screw 35, FIG. 2, as necessary, the length of horizontal protrusion beyond the pivot hole 22 is readily achieved. Such an adjustment is necessary to accommodate differing types of pool configurations.

As shown in FIG. 2, rod 32 is concentrically telescoped within mating half 33. Member 33 has a centrally located screw type guide 35 which slideably mates with slot 34 thereby providing a mostly one time adjustment which optimize the distance between the pivot rod 30 in finger hole 22 and the edge of the pool 42. Once this horizontal distance is set it rarely needs to be reset. Such a setting is simply done by use of a screw driver which is readily available to every homeowner.

Returning to FIG. 1, the flow deflector assembly proper is comprised of a capped support rod 62, a flotation member 65, and a deflector face 61. Face 61 and flotation member 65 are combined and attached to rod 62, perhaps with sheet metal type screws 63 and 64, thereby creating a floating deflector assembly 60 which serves to deflect debris such as the leaves on the water surface.

Moving now to FIG. 3, the middle and vertical leg 53 of my invention is configured with a pair of vertical concentrically mating adjustment rods 58 and 55 . Outer rod 55 is longitudinally slotted to include a slot 54 which may run approximately ⅓ of its length. Inner rod 58 receives a set screw 51 which provides an adjustable length setting for vertical adjustment.

Rods 54 and 55, FIG. 3, are each fitted with right angle elbows 56 and 57 which respectively mate with the two horizontal assemblies 33 and 62 of my deflector 60. Thus, the combination of adjustment bar 53 and elbows 56 and 57 form a rigid vertical member which rests firmly against vertical pool face 42 when my deflector 60 is in operation.

Pivot 22 and the vertical pool face 42 thus form a two point stop that does not require any further fixture attachment devices that characterize much of the prior art. Together, the two points serve to solidly position my deflector assembly 60 at the proper angular position in water flow 45 (as shown in FIG. 1). These two stop points stabilize the deflector 60 for either one of the two chosen directions of flow of pool water caused by the filtration system.

In some deck configurations the coping of the deck overhangs the pool edge . If such is the case the stop for my deflector 60 may consist of the elbow 56 or downward rod 54 resting against the outboard coping edge (not shown). Otherwise the lower part of the elbow 57 may be offset a sufficient distance such that the stop is again the vertical edge 42 of the pool.

Returning to FIG. 1, the angle of attack 44 (shown by arc 44) relative to the water flow 45 is adjustable by a one time setting of set screw 72 in elbow 57. Likewise, deflector face 61 may be rotationally positioned 180 degrees with set screw 73 in elbow 57. These simple adjustment points permit the user to easily configure for either clockwise or counterclockwise water flow.

As the description of my apparatus has made clear, the method steps of my invention are of substantial novelty. Simply stated the inventive method involves employing an opening in the deck as a pivot location for an outrigger assemblage that is connected to a floating deflector. The floating deflector is partially submerged in the surface of the pool water and is held in a preferred location adjacent to a skimmer entrance port by an upstanding portion of the outrigger assemblage near the edge of the pool.

This outrigger assemblage is comprised of a horizontal adjustment member that is held above the deck surface by the floating deflector and is held in position by the deck opening and a vertical pivot rod that is attached at the inboard end of the horizontal adjustment member. Attached to the other end of the horizontal adjustment member is a second adjustment member that is vertically descending and is further connected at a right angle to the flotation member of my deflector.

My vertically oriented adjustment member rests against the side of the pool, or deck, and that resting spot together with the pivot point opening of the deck surface locks the deflector in a fixed and desired position for sweeping surface debris into the skimmer entrance port.

While my invention has been described with reference to a particular example of preferred embodiments, it is my intention to cover all modifications and equivalents within the scope of the following claims. It is therefore requested that the following claims, which define my invention, be given a liberal interpretation which is within the spirit and scope of my contribution to this art.

What is claimed is:

1. A swimming pool skimmer apparatus for a pool having a deck, a skimmer access cover and a vertical pool surface, said apparatus comprising:

a floating deflector arm having a flat deflector surface partially submerged in the water surface of a swimming pool;

a pair of adjustable orthogonal members rigidly connected together and to the floating deflector arm;

a first one of said pair being vertically oriented adjacent the side of the swimming pool and resting against the vertical pool surface so as to direct floating debris from said flat deflector surface into a skimmer entrance port for the pool;

a second one of said pair being horizontally oriented above the swimming pool deck and extending away from the pool side to a point over a skimmer access cover having therein a finger hole for ease of removal of said cover; and a vertical pivot rod downwardly directed from the end of said second adjustable member, which rod loosely fits within a finger opening in said skimmer access cover so as to provide an anchor point for stabilizing said deflector at a position adjacent to said skimmer entrance port.

2. A swimming pool skimmer apparatus in accordance with claim 1 wherein said pool includes a direction of water flow movement caused by a pool filtration system, and said deflector further comprises:

an angular adjustment means connecting said vertical member to said floating member; and means associated with said angular adjustment means for positioning said floating member at an angle appropriate for either clockwise or counterclockwise flow directions for said pool water.

3. A swimming pool skimmer apparatus in accordance with claim 1 and further comprising:

said adjustment pair each including concentrically sliding members telescoped together with one of said members being slotted with a slot therein; and a set screw adjustment seated through said slot in order to provide a one time field setting as required by a particular pool configuration.

4. A swimming pool skimmer apparatus in accordance with claim 1 and further comprising:

a pivot point of securement at an opening in the skimmer entrance port cover which opening serves as a singular loose fit for a vertically oriented cylindrical pivot stub that is connected to the horizontally oriented adjustment member.

5. A swimming pool skimmer apparatus in accordance with claim 1 wherein no permanent attachment fixtures are required, and said apparatus further comprises:

a light weight plastic pipe with a deflector rod sealed to float on the water surface of the pool; and a deflector which self adjusts with surface movement of the pool water and thus is both self-tending and as required easily put into or removed from operation.

6. A swimming pool skimmer apparatus in accordance with claim 1 wherein no permanent attachment fixtures are required, and said apparatus further comprises:

said second one of said adjustment pair comprised by a pair of telescoped members, one of which has therein a longitudinal slot and a set screw passing through said slot and into the other member of said pair for a length adjustment.

7. A swimming pool skimmer apparatus in accordance with claim 1 wherein said flat deflector surface serves to deflect debris on the water surface into said skimmer port and said apparatus further comprises:

a capped support rod surrounded by a flotation member and means fastening said flat deflector surface to said support rod.

8. A swimming pool skimmer apparatus in accordance with claim 1 wherein said flat deflector surface serves to deflect debris on the water surface into said skimmer port and said first vertical adjustment apparatus further comprises:

a first one of said pair being vertically oriented adjacent the side of the swimming pool and resting against the vertical pool surface so as to direct floating debris from said flat deflector surface into a skimmer entrance port for the pool;

a pair of vertical concentrically mating adjustment rods telescoped together with one of said rods having a longitudinal slot for receiving a set screw in order to provide an adjustable length setting for said vertical adjustment.

9. A swimming pool skimmer apparatus in accordance with claim 1 wherein said flat deflector surface serves to deflect debris on the water surface of a pool into said skimmer port, and said first vertical adjustment apparatus further comprises:

telescoping pipes each fitted with right angle elbows and which respectively mate with the two horizontal adjustment assemblies to form a rigid vertical member which rests firmly against the vertical pool side when said deflector is in use.

10. A swimming pool skimmer apparatus in accordance with claim 9 wherein said pivot rod and the edge of the pool side form a two point stop to solidly stabilize said deflector at the proper angular position in the pool water flow so as to deflect debris into said skimmer entrance port.

11. A method of skimming floating debris from the surface of a swimming pool that contains a skimmer entrance port, a sunken skimmer basket covered by an access cover with a finger hole therein, said method comprising the steps of;

employing said finger hole opening in said cover as a fixed location for an outrigger assemblage which incorporates a floating deflector;

partially submerging said floating deflector in the surface of the pool water at a location adjacent said skimmer entrance port; and resting said assemblage against the side of the swimming pool in order to stabilize said assemblage at said skimmer entrance port.

12. A method of skimming floating debris from the surface of a pool in accordance with claim 11 and comprising the additional steps of:

dropping a downward lug of said outrigger assemblage into said finger hole of said cover such that said outrigger is fixed in place adjacent to said skimmer entrance port.

13. A method of skimming floating debris from the surface of a pool in accordance with claim 12 and comprising the additional steps of:

extending above the pool deck a horizontal adjustment member that remains above the deck surface by the floating deflector and the downward lug.

14. A method of skimming floating debris from the surface of a pool in accordance with claim 13 and comprising the additional steps of:

attaching to the horizontal adjustment member a second vertically descending adjustment member; and attaching said floating deflector at a right angle to said vertically extending adjustment member.

15. A method of skimming floating debris from the surface of a pool in accordance with claim 14 and comprising the additional steps of:

telescoping pieces of plastic pipes which slidingly mate with each other to form an adjustment assembly that is fixed in place by a set screw after a desired adjustment has been achieved.

16. Apparatus for skimming floating debris from the surface of a swimming pool that contains a skimmer entrance port, a sunken skimmer basket covered by an access cover with a finger hole therein, said apparatus comprising the steps of;

an outrigger assemblage which incorporates a floating deflector and a depending stub insertable into said finger hole opening in said cover;

said floating deflector being partially submerged in the surface of the pool water at a location adjacent said skimmer entrance port; and means on said assemblage resting against the side of the swimming pool for stabilizing said assemblage at said skimmer entrance port location.

17. Apparatus for skimming floating debris from the surface of a pool in accordance with claim 16 wherein said assemblage further comprises:

a horizontal adjustment member self-positioned above the deck surface by the floating deflector and the downward stub.

18. Apparatus for skimming floating debris from the surface of a pool in accordance with claim 17 and further comprising:

a vertically descending adjustment member attached to the horizontal adjustment member; and means attaching said floating deflector at a right angle to said vertically extending adjustment member.

* * * * *